US010000867B2

(12) United States Patent
Hiepp et al.

(10) Patent No.: US 10,000,867 B2
(45) Date of Patent: Jun. 19, 2018

(54) DEVICE AND METHOD FOR DETERMINING THE DIAMETER OF A YARN BALLOON FORMED BY A RUNNING YARN AT A WORKSTATION OF A TEXTILE MACHINE

(71) Applicant: Saurer Germany GmbH & Co. KG, Remscheid (DE)

(72) Inventors: Magnus Hiepp, Kempten (DE); Walter Pede-Vogler, Durach (DE); Alexander Thaler, Burggen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 127 days.

(21) Appl. No.: 15/097,337

(22) Filed: Apr. 13, 2016

(65) Prior Publication Data

US 2016/0312386 A1 Oct. 27, 2016

(30) Foreign Application Priority Data

Apr. 27, 2015 (DE) ..... 10 2015 005 328

(51) Int. Cl.
*D01H 13/26* (2006.01)
*B65H 57/22* (2006.01)
*D02G 3/28* (2006.01)

(52) U.S. Cl.
CPC ..... *D01H 13/26* (2013.01); *B65H 57/22* (2013.01); *D02G 3/285* (2013.01)

(58) Field of Classification Search
CPC ..... D01H 13/22; D01H 13/26; D01H 13/32; B65H 57/00; B65H 57/02; D02G 3/285
See application file for complete search history.

(56) References Cited

U.S. PATENT DOCUMENTS 2,386,704 A * 10/1945 McLellan ..... D01H 1/425 57/357
2,625,786 A * 1/1953 Klein ..... D01H 7/86 57/279
2,851,848 A 9/1958 Vibber
(Continued)

FOREIGN PATENT DOCUMENTS

DE 2255663 A1 5/1974
DE 10103892 A1 8/2002
(Continued)

OTHER PUBLICATIONS

European Search Report for corresponding European Patent Application No. 16000763.9 dated Aug. 30, 2016; all enclosed pages cited.

*Primary Examiner* — Ismael Izaguirre
(74) *Attorney, Agent, or Firm* — Nelson Mullins Riley & Scarborough LLP

(57) ABSTRACT

A device for determining the diameter of a yarn balloon (B) formed by a running yarn at a workstation (1) of a textile machine wherein the workstation (1) is provided with a mechanical, contact scanning sensor (22), which is designed and arranged so that during the operation of the workstation (1) it is positioned by a yarn forming the thread balloon (B) in an operating position dependent on the diameter of a thread balloon (B), and a sensor device (24) is provided which detects the operating position (BS) of the scanning sensor (22).

17 Claims, 4 Drawing Sheets

(56) References Cited

U.S. PATENT DOCUMENTS

| | | | | | |
|---|---|---|---|---|---|
| 3,840,869 | A * | 10/1974 | Pugh | B65H 63/0324 | 139/370.2 |
| 3,899,867 | A * | 8/1975 | Northup | B65H 51/16 | 57/18 |
| 4,023,342 | A * | 5/1977 | Schenkel | D01H 1/32 | 57/124 |
| 4,311,916 | A * | 1/1982 | Schenkel | D01H 13/145 | 250/559.43 |
| 4,399,648 | A * | 8/1983 | Kato | D01H 13/26 | 250/559.29 |
| 4,888,944 | A | 12/1989 | Felix | | |
| 6,219,136 | B1 * | 4/2001 | Kuo | D04B 5/20 | 356/238.2 |
| 8,256,199 | B2 | 9/2012 | Schlagenhaft | | |
| 2011/0126506 | A1 * | 6/2011 | Schlagenhaft | D01H 1/10 | 57/58.86 |

FOREIGN PATENT DOCUMENTS

| | | | |
|---|---|---|---|
| DE | 102008033849 | A1 | 1/2010 |
| EP | 0282745 | A1 | 9/1988 |
| EP | 2419554 | B1 | 2/2012 |
| FR | 2944296 | A1 | 10/2010 |

* cited by examiner

DEVICE AND METHOD FOR DETERMINING THE DIAMETER OF A YARN BALLOON FORMED BY A RUNNING YARN AT A WORKSTATION OF A TEXTILE MACHINE

CROSS-REFERENCE TO RELATED APPLICATIONS

This application claims priority from German National Patent Application No. DE 102015005328.0, filed Apr. 27, 2015, entitled "Vorrichtung and Verfahren zum Ermitteln des Durchmessers eines durch einen laufenden Faden gebildeten Fadenballons an einer Arbeitsstelle einer Textilmaschine", the entire contents of which are incorporated herein by reference.

FIELD OF THE INVENTION

The present invention relates to a device and an associated method for determining the diameter of a yarn balloon formed by a running yarn at a workstation of a textile machine.

BACKGROUND OF THE INVENTION

In the textile machine industry different embodiments of production machines have been known for a long time in which yarn balloons are formed during operation in the region of their often numerous workstations or associated operating devices.

Such production machines therefore have monitoring devices for determining and limiting the size of said yarn balloon, which can operate in very different ways. The known monitoring devices often have optical sensor devices for example, by means of which the rotating yarn that forms the yarn balloon is observed.

In German Patent Publication DE 101 03 892 A1 for example a method and a device are described by means of which the yarn take-off speed of feed bobbins arranged in the creel of a beaming machine is optimised.

It is known that when a yarn is drawn off a feed bobbin, which is positioned in an associated creel during the operating process overhead and at a relatively high take-off speed, a yarn balloon is formed, the diameter of which is dependent on the yarn take-off speed. The size of the yarn balloon thus increases with increasing yarn take-off speed.

In the method known from German Patent Publication DE 101 03 892 A1 by means of measuring means arranged on the creel the size of at least some of the yarn balloons created during the yarn take off is determined and transmitted to a control device, which when reaching limit values of the yarn balloon ensures that the yarn take-off speed is controlled by intervention.

As measuring means for determining the yarn balloon size various different optically operating measuring units are used, for example a camera, one or more light barriers or similar devices.

Optically operating measuring devices for detecting a yarn balloon form and/or a yarn balloon size are known from German Patent Publication DE 22 55 663 A1 and European Patent Publication EP 0 282 745 A1 also in connection with ring spinning machines.

In German Patent Publication DE 22 55 663 A1 for example a workstation of a ring spinning machine is described which is equipped with an air or magnet-mounted spinning ring, on which a spinning rotor runs driven by the running yarn.

As during the operation of such workstations, in order to ensure a perfect spinning process, it is known that it is necessary to have a specific difference between the speed of the spinning ring and the speed of the spinning rotor, during the spinning operation both the speed of the air or magnet mounted spinning ring and also the speed of the spinning rotor is controlled.

Furthermore, in this method there is continuous monitoring of whether a predefined maximum yarn tension is being maintained and the yarn balloon forming during the spinning in the region of the spinning cop is controlled and also stabilised. This means that by measuring the deviation of the yarn curve of the yarn balloon from its meridian plane and adjusting the yarn tension accordingly by means of variably braking the spinning ring, the course of the yarn curve of the yarn balloon is stabilised. The device for detecting the deviation in the yarn curve of the yarn balloon consists essentially of a measuring sensor which comprises a series of small photoelements as well as a trigger device which ensures that the yarn balloon is periodically flashed.

The known devices are either (German Patent Publication DE 22 55 663 A1) relatively complicated and often very inaccurate or because of their large measurement range (German Patent Publication DE 101 03 892 A1) are often very sensitive to air pollution.

Therefore in practice these known devices have not won general acceptance.

European Patent Publication EP 0 282 745 A1 describes a method and a device for monitoring the production and quality of the workstations of a multi-spindle textile machine.

This means that a ring spinning machine is equipped with an optical monitoring element, which simultaneously checks a plurality of workstations of the textile machine arranged next to one another in series in that the yarn balloons rotating in the region of the workstation are illuminated.

The monitoring element comprises for this purpose a transmitter and a receiver, which are designed and arranged so that a beam bundle sent by a transmitter on route to a receiver passes through the numerous, rotating yarn balloons and is interrupted or weakened intermittently by the yarn balloons.

The shadow is converted in the receiver into an electric signal which is used in an associated control device as the basis for further evaluation.

Also the method described in European Patent Publication EP 0 282 745 A1 is occasionally very inaccurate as the beam bundle is often influenced negatively on route from the transmitter to the receiver by dust and fibre particles which are almost impossible to avoid in the atmosphere of a spinning room.

Furthermore, by means of European Patent Publication EP 2 419 554 B1 a workstation of a two-for-one twisting and cabling machine is known, the spooling and winding device of which is arranged so that during operation it lies inside a yarn balloon.

In order to check the size of the yarn balloon the workstation has a monitoring device which can have various different embodiments.

The size of the yarn balloon can be determined for example by a yarn tension sensor, which is arranged either between a yarn drive device and the inlet of the yarn into a spindle, which ensures the formation of the yarn balloon or by means of a yarn tension sensor, which is positioned between the outlet of the yarn from the spindle and an additional yarn drive device.

In a further embodiment it is possible to detect the size of the yarn balloon and also measure the output or torque of the drive device of the spindle. This means that by means of a measuring device the power is determined which is received by the spindle drive and from this the size of the yarn balloon can be determined in an evaluation device.

From European Patent Publication EP 2 419 554 B1 also the use of different optical measuring devices is known which monitor the yarn balloon rotating around the spooling and winding device.

In a first embodiment for example the use of a light barrier is proposed which has a light source for emitting a light beam and a light-sensitive detector for picking up the light beam.

In a comparable, second embodiment a type CCD light sensor is used in connection with a beam-like, stroboscope light source, for example LED or laser.

In the device which operates with a light barrier, during operation the interruption of the light beam is identified by the yarn of the yarn balloon running past.

In the device which acts with a light sensor and a stroboscopic light source, which is synchronised with the rotation of the spindle, the image and thereby the form of the yarn forming the yarn balloon is localised when it is lit up by a flash.

The various different monitoring devices described in European Patent Publication EP 2 419 554 B1 in connection with a workstation of a two-for-one twisting and cabling machine can also be improved upon, as they either do not take accurate enough measurements or are also relatively sensitive to dirt.

SUMMARY OF THE INVENTION

On the basis of the aforementioned prior art the invention proposes to develop a device and a method, by means of which the diameter of a yarn balloon formed by a running yarn can be reliably determined even in difficult environmental conditions.

The relevant device should also be as simple as possible in its construction and also not be sensitive to dirt.

According to the invention, a device for reliably determining the diameter of a yarn balloon formed by a running yarn at a workstation of a textile machine utilizes a mechanical, contact scanning sensor, which is designed and arranged so that during the operation of the workstation it is positioned by the yarn balloon in an operating position dependent on the diameter of a yarn balloon and a sensor device is provided which detects the operating position of the scanning sensor.

According to an associated method for operating the device, the operating position of the scanning sensor, which is predefined by the diameter of the yarn balloon (B), is detected by the sensor device.

Further advantageous embodiments of the device and the associated method according to the invention are also provided.

The device according to the invention has in particular the advantage that by using a mechanical scanning sensor, which with contact bears on the yarn forming the yarn balloon, regardless of the environmental conditions, for example the dust levels in the region of the workstation, the correct yarn balloon size is always determined directly and in that said yarn balloon size indicated by the operating position of the scanning sensor is identified reliably and exactly by a sensor device and can be transmitted for evaluation to devices connected downstream, which if necessary in connection with the yarn tension of the outer yarn introduce control measures.

The use of a mechanical scanning sensor also enables a compact structure of the workstation with the result that the space required for setting up a two-for-one twisting or cabling machine is reduced.

The sensor device, by means of which the operating position of the mechanical scanning sensor is detected can be designed to be very different. As a sensor device an optically operating device is possible for example, e.g. a so-called measuring position sensor.

A measuring position sensor of this kind optically detects the respective distance between the sensor device and the scanning sensor positioned in the operating position and then sends a corresponding electrical signal to a control circuit connected downstream.

However, in principle to detect the operating position of a mechanical scanning sensor it is also possible to use other types of sensor devices.

For example a sensor device can also be used which establishes what angle of rotation the scanning sensor has in relation to a zero position when the scanning sensor is positioned in a specific operating position.

The mechanical scanning sensor, which bears with contact on the running yarn which forms the yarn balloon and which is thereby positioned in an operating position which corresponds to the respective diameter of the yarn balloon can have different advantageous embodiments.

In an advantageous embodiment the scanning sensor bears on the spindle pot when the spindle of a workstation is in a position of rest. By means of such a design it is ensured in a simple manner that the scanning sensor is always positioned in a defined position even with a switched off workstation, with the result that the scanning sensor can be immediately activated when the workstation is restarted.

In a first advantageous embodiment the scanning sensor is designed for example as a clip which is convex relative to the yarn balloon, and mounted pivotably at the ends, which bears on the yarn balloon from the outside. The pivot axis of the clip is thus spaced apart from the yarn balloon and at right angles to the axis of rotation of the yarn balloon so that the clip is lifted by the running yarn which forms the yarn balloon and is positioned in an operating position which is dependent on the diameter of the yarn balloon and which can be identified reliably by an associated sensor device.

In a further, second embodiment the scanning sensor is designed as a clip which is concave relative to the yarn balloon and pivotable at the ends which also bears on the yarn balloon from the outside.

Here too the pivot axis of the clip is at right angles to the axis of rotation of the yarn balloon and is arranged so that the clip is lifted by the running yarn and is positioned in an operating position dependent on the diameter of the yarn balloon. As in the first embodiment the operating position of the clip can then be easily detected by an associated sensor device.

In a third embodiment the scanning sensor, similar to the second embodiment described above is designed as a clip, which is concave relative to the yarn balloon and mounted pivotably at the ends.

However, the clip in this embodiment bears on the yarn balloon from the inside.

The operating position of the clip can also be detected here by an associated sensor device.

Preferably, the scanning sensor in the two embodiments described above in the area in which the clip of the scanning sensor is tangential to the yarn balloon has a curvature pointing respectively in the direction of the yarn balloon. By means of such a curvature the area of contact of the clip with the running yarn which is known to form a yarn balloon is minimised, which has a positive effect on the yarn quality. This means that by means of such a curvature the surface contact of the yarn material which can cause yarn-damage is minimised.

In a further advantageous embodiment the scanning sensor can also be designed as a spring-loaded scanning feeler bearing on the yarn balloon from the outside.

The scanning feeler can either be designed to be linear or to have a concave curve relative to the yarn balloon. In both embodiments the operating position, similar to the aforementioned scanning sensors with clip, can be detected reliably by a sensor device.

In a linear design of the scanning feeler it is advantageous to make the scanning feeler from an elastic, wear-resistant material, for example spring steel, and to position the scanning feeler on one of its end sides in a bearing position so that it bears against the yarn balloon formed by the running yarn.

If the scanning feeler has a concave curvature relative to the yarn balloon it is advantageous to mount the scanning feeler on one of its ends side in a pivot bearing and load its opposite end sides with a spring element so that the scanning feeler with its concave curvature is tangential to the yarn balloon formed by the running yarn.

In an advantageous embodiment it is also the case that for influencing the form and the diameter of the yarn balloon a device is provided, by means of which the yarn tension of an outer yarn on a two-for-one twisting or cabling machine can be adjusted and the device is connected to a control circuit which processes the signals of the sensor device.

The device for influencing the yarn tension of the outer yarns can thus either be designed as a brake or as an active delivery device. The connected control circuit thereby ensures that there is automatically always an optimum yarn balloon size.

In a further advantageous embodiment the scanning sensor can be positioned optionally in a position of rest, in which there is no contact with the yarn balloon. This means that a scanning sensor according to the invention is preferably used during the start/stop phases of the workstations and can be positioned in a position of rest during normal operation in a way that protects the material in which it is pivoted away from the rotating yarn balloon.

As already indicated above in connection with the device according to the invention in the method according to the invention the diameter of a yarn balloon formed by a running yarn is determined at a workstation of a textile machine in that the operating position of a scanning sensor, which corresponds to a specific diameter of the yarn balloon, is detected by the sensor device. The operating position of the scanning sensor detected by the sensor device is processed in a control circuit and used in the connected device for influencing the yarn tension of the outer yarn such that the yarn balloon has an optimal diameter.

By means of the method according to the invention it is ensured in particular that the scanning sensor is immediately active when the workstation is started up. This means that it is ensured that the scanning sensor is operating perfectly particularly in the start/stop phase of a workstation.

In a further advantageous embodiment the operation position of the scanning sensor detected by the sensor device is processed in a control circuit and used in a connected device for advantageously influencing the yarn tension of an outer yarn and/or an inner yarn on a two-for-one twisting or cabling machine.

Preferably, the control circuit always ensures that the yarn balloon size is automatically optimal, i.e. it has a minimal yarn balloon size as far as possible according to the existing operating and material parameters.

The scanning sensor is preferably used during the start/stop phases of the workstation, whereas during normal operation it is positioned in a position of rest in which it is pivoted away from the rotating yarn balloon.

In this way on the one hand, in particular in the critical phases of the workstation, correct operation can be ensured and on the other hand it can also be ensured that the material stress of the scanning sensor is minimised and thus the lifetime of the scanning sensor is extended.

The scanning sensor according to the invention can however be used not only for determining the form and the diameter of a yarn balloon but also for monitoring yarn breaks. This means a specific operating position of the scanning sensor can be used as an indication of the presence of a yarn break. Additional yarn break sensors are thus no longer needed at the workstations.

BRIEF DESCRIPTION OF THE DRAWINGS

The invention is explained in more detail in the following with reference to various example embodiments shown in the drawings wherein.

DETAILED DESCRIPTION OF THE INVENTION

Figure 1:
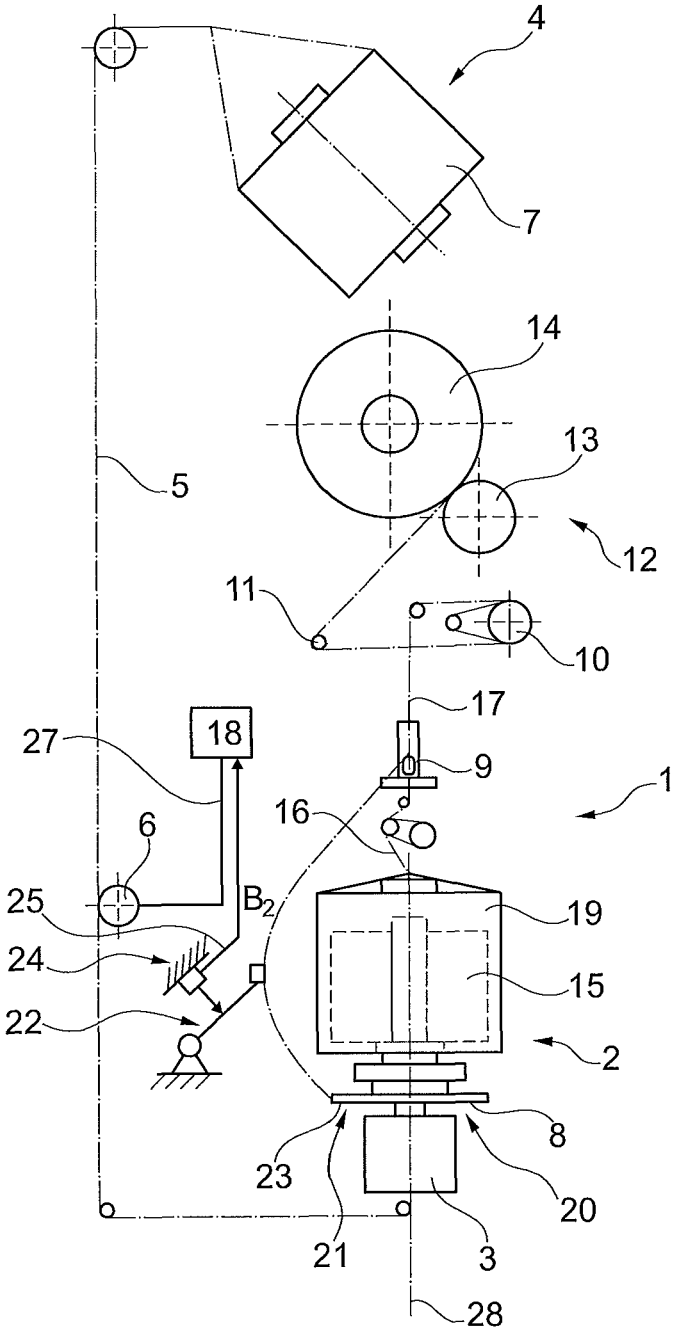
FIG. 1 shows schematically, in side view a workstation of a two-for-one twisting or cabling machine, which comprises a mechanical scanning sensor for determining the diameter of a yarn balloon.

FIG. 1 shows schematically, in side view a workstation 1 of a two-for-one twisting or cabling machine, which as usual comprises a creel 4 positioned generally above or behind the workstation 1, which is used for receiving at least one first feed bobbin 7, from which the so-called outer yarn 5 is drawn off.

The workstation 1 also has a spindle 2, in the present example embodiment a cabling spindle, which is equipped with a spindle pot 19, in which a second feed bobbin 15 is mounted from which a so-called inner yarn 16 is drawn off overhead. The inner yarn 16 is supplied to balloon eyelet arranged above the spindle 2 or a so-called balancing system 9.

The spindle pot 19 is mounted on the rotatable yarn guiding device 20, which is designed in the example embodiment as a twisting plate 8. The spindle pot 19 supported on the rotatable yarn guiding device 20 is preferably secured against rotation by a (not shown) magnet device.

The yarn guiding device 20 of the spindle 2 is loaded by a spindle drive 3 which is either a direct drive or an indirect drive. In the latter case the yarn guiding device 20 is connected for example by a belt drive to a corresponding drive.

The outer yarn 5 drawn from the first feed bobbin 7 is supplied to a device 6 for influencing the yarn tension arranged in the yarn run between the creel 4 and the spindle 2, by means of which the yarn tension of the outer yarn 5 can be varied if necessary.

The device 6 is connected by control lines 27 to a control circuit 18, which controls the yarn tension supplied by the device 6 to the outer yarn 5. This means the outer yarn 5 following the device 6 runs through the spindle drive 3 in the region of the rotary axis 28 of the spindle drive and exits underneath the twisting plate 8 through a so-called yarn exit bore in radial direction out of the hollow axis of rotation 28 of the spindle drive 3. The outer yarn 5 then runs to the outer part of the twisting plate 8, where a fixed throw-off point 21 is installed for the outer yarn 5. This fixed throw-off point 21 is designed according to the present example embodiment as an eyelet 23.

However, in connection with a yarn guiding device 20, which has a fixed throw-off point 21, also other embodiments are possible and can be used in practice.

In the present example embodiment the outer yarn 5 is diverted upwards in the region of the eyelet 23 of the twisting plate 8 and rotates around the spindle pot 19 of the spindle 2 forming a free yarn balloon B, in which spindle a second feed bobbin 15 is positioned. A mechanical scanning sensor 22 bears with contact on the yarn balloon B, the operating position BS of which is monitored by a sensor device 24 which is connected via a signal line 25 to the control circuit 18.

The outer yarn 5 drawn from the first feed bobbin 7 and the inner yarn 16 drawn from the second feed bobbin 15 are brought together in the region of the balloon eyelet or the balancing system 9.

As shown in FIG. 1, by means of the position of the balloon eyelet or the balancing system 9 the height of the forming free yarn balloon B is determined. In the balloon eyelet or in the balancing system 9 is the so-called cabling or also cording point in which the two yarns, the outer yarn 5 and the inner yarn 16, run together and form a cord yarn 17 for example.

Above the cabling point a yarn take-off device 10 is arranged, by means of which the cord yarn 17 is taken off and supplied via a balancing element, such as for example a compensator device 11, to a spooling and winding device 12.

The spooling and winding device 12 comprises, as usual, a drive roller 13 which frictionally drives a bobbin 14.

The device 6 for influencing the yarn tension is designed either as an electronically controlled brake or as an active delivery device, wherein also a combination of the two aforementioned components can be used.

As embodiment variants of a delivery device for example a godet, a lamellar disc or a drive roller with corresponding pressure roller is possible.

The device 6 is connected via control lines 27 to a control circuit 18 which is also connected via the signal line 25 to the sensor device 24 of the scanning sensor 22. This means the device 6 controls the yarn tension of the outer yarn 5 as a function of the diameter of the free yarn balloon B, which is determined by contact by means of the scanning sensor 22, and by means of the sensor device 24, which converts the operating position BS of the scanning sensor 22 into an electric signal, is conveyed to the control circuit.

The controllable yarn tension applied by the device 6 to the outer yarn 5 preferably has a size which, depending on the geometry of the spindle 2, optimises the free yarn balloon B.

FIGS. 2A-C and 3-6 show various different embodiments of a mechanical scanning sensor.

Figure 2A:
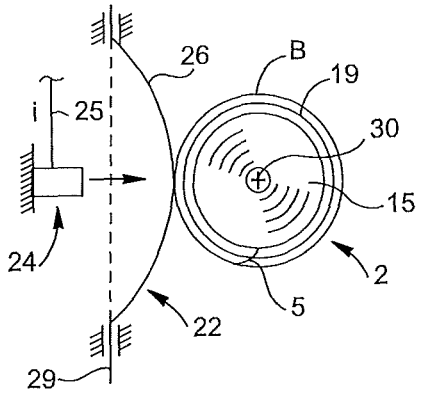
FIG. 2A shows a mechanical scanning sensor, which is designed as a convex clip which is mounted pivotably at the ends, which bears on the yarn balloon from the outside.

FIG. 2A shows for example a mechanical scanning sensor 22, which is designed as a clip 26 which is convex relative to the yarn balloon B and mounted pivotably at the ends which bears on the yarn balloon B from the outside. The pivot axis 29 of the clip 26 is spaced apart from the yarn balloon B and arranged at right angles to the axis of rotation 30 of the yarn balloon B so that the clip 26 is lifted by the running yarn, in the present example embodiment by the outer yarn 5, which forms the yarn balloon B and is thus positioned in an operating position BS.

The operating position BS of the scanning sensor 22 is recognised reliably by the associated sensor device 24 and sent via the signal line 25, as an electric signal i, for further processing to the control circuit 18.

Figure 2B:
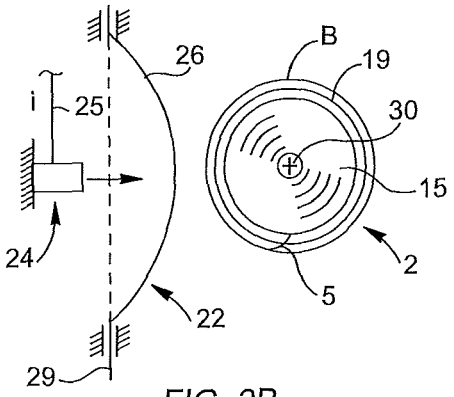
FIG. 2B shows the mechanical scanning sensor positioned optionally in a position of rest, in which there is no contact with the yarn balloon.
Figure 2C:
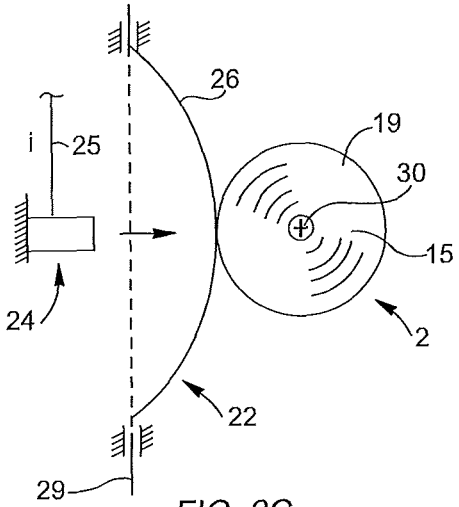
FIG. 2C shows the mechanical scanning sensor resting on the spindle pot.
Figure 3:
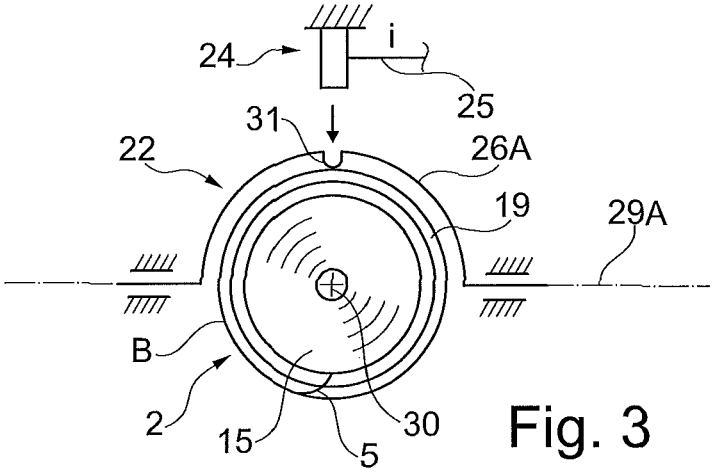
FIG. 3 shows a mechanical scanning sensor, which is designed as a concave clip mounted pivotably at the ends which bears on the yarn balloon from the outside and has a curvature pointing in the direction of the yarn balloon.

FIG. 2B shows the mechanical scanning sensor 22 positioned optionally in a position of rest (RS), in which there is no contact with the yarn balloon B. FIG. 2C shows the mechanical scanning sensor 22 resting on the spindle pot 19. FIG. 3 shows a mechanical scanning sensor 22, which comprises a clip 26A which is concave relative to the yarn balloon B and mounted pivotably at the ends, which bears on the yarn balloon B from the outside. The clip 26A has a curvature 31 in the direction of the yarn balloon B, by means of which the contact of the running outer yarn 5 with the clip 26A is minimised and thus the yarn is protected.

The pivot axis 29A of the clip 26A is at right angles to the axis of rotation 30 of the yarn balloon B and is arranged so that the clip 26*a* is lifted by the yarn balloon B and thereby positioned in an operating position BS, which as in the example embodiment of FIG. 2A, is recognised by the associated sensor device 24 and is sent via the signal line 25, as an electric signal i, for further processing to the control circuit 18.

Figure 4:
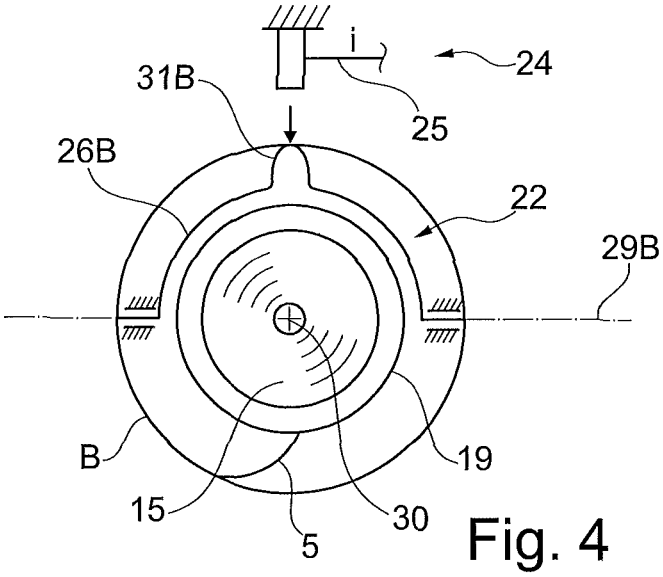
FIG. 4 shows a mechanical scanning sensor, which is designed as a concave clip mounted pivotably at the ends, which bears on the yarn balloon from the inside and has a curvature pointing in the direction of the yarn balloon.

The embodiment of a scanning sensor 22 shown in FIG. 4 corresponds essentially to the embodiment of a scanning sensor already known from FIG. 3. This means that the scanning sensor 22 has a clip 26*b* which is concave relative to the yarn balloon B and mounted pivotably at the ends.

The clip 26B bears against the yarn balloon B from the inside and therefore has a curvature 31B outwards in the direction of the yarn balloon B, by means which, as already explained above, the contact of the running outer yarn 5 with the clip 26B is minimised and the yarn is thus protected which has a positive effect on the yarn quality.

The pivot axis 29B of the clip 26B is at right angles to the axis of rotation 30 of the yarn balloon B and is arranged so that the clip 26A is lifted by the yarn balloon B and thereby positioned in an operating position BS, which as in the example embodiment of FIGS. 2A and 3 is recognised by the associated sensor device 24 and sent via the signal line 25 as an electric signal i for further processing to the control circuit 18.

In a further advantageous embodiment the scanning sensor 22 can also be designed however as a spring-loaded scanning feeler 32 bearing on the yarn balloon B from the outside.

Figure 5:
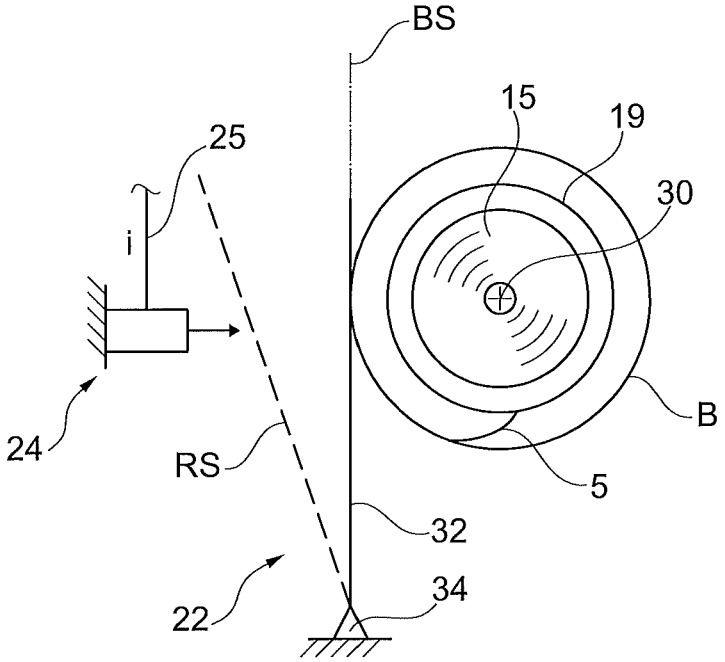
FIG. 5 shows a mechanical scanning sensor which is designed as a linear scanning feeler.
Figure 6:
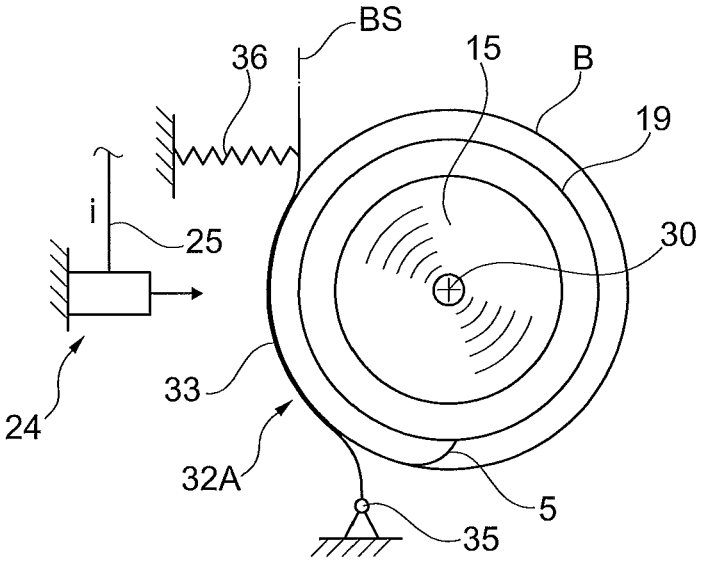
FIG. 6 shows a mechanical scanning sensor which is designed as a concave scanning feeler.

The scanning feeler 32 can be designed to be linear, as shown in FIG. 5, or as shown in FIG. 6 can have a concave curvature 33 relative to the yarn balloon B.

In the linear design of the scanning feeler 32 shown in FIG. 5 it is advantageous, to make the scanning feeler 32 from an elastic, wear-resistant material, for example spring steel, and to mount the scanning feeler 32 at one of its ends sides in a bearing position 34 so that it is positioned in the yarn balloon B of the running outer yarn 5 by the yarn in an operating position BS, which as explained above is identified by a sensor device 24 and reported to the control circuit 18.

If the scanning feeler 32A, as shown in FIG. 6, has a concave curvature 33 relative to the yarn balloon B, it is advantageous to mount the scanning feeler 32A at one of its end sides in a pivot bearing 35 and to load the latter on its opposite end side with a spring element 36 so that the scanning feeler 32A bearing on the yarn balloon B of the running outer yarn 5 is positioned by the yarn in an operating position BS which is identified by the sensor device 24 and reported to the control circuit 18.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Device for determining the diameter of a thread balloon (B) formed by a running thread at a workstation (1) of a textile machine, wherein the textile machine having a plurality of workstations (1), each of which having a device (6) for influencing a yarn tension of the outer thread (5), which device (6) is connected to a control circuit (18), a spindle (2), a spindle pot (19) for receiving a second feed bobbin (15), a rotatable thread guiding device (20), a balancing system (9) for forming a cabling or cording point and a spooling and winding device (12), characterised in that the workstation (1) has a mechanical, contact scanning sensor (22) which is designed and mounted pivotably so that during the operation of the workstation (1) a position of the scanning sensor (22) is changed by a yarn forming the thread balloon (B) to an operating position (BS) dependent on the diameter of the thread balloon (B), and in that the workstation (1) has a sensor device (24) which senses the operating position (BS) of the scanning sensor (22).

2. Device according to claim 1, characterised in that in the position of rest of a spindle (2) of the workstation (1) the scanning sensor (22) lies on the spindle pot (19).

3. Device according to claim 1, characterised in that the scanning sensor (22) is in a form of a clip (26) which is convex relative the thread balloon (B) and mounted pivotably at the ends, which bears on the thread balloon (B) from the outside.

4. Device according to claim 1, characterised in that the clip (26A) is concave relative to the thread balloon (B) and mounted pivotably at the ends, which bears on the thread balloon (B) from outside of the clip.

5. Device according to claim 1, characterised in that the clip (26B) which is concave relative to the thread balloon (B) and mounted pivotably at the ends, bears on the thread balloon (B) from the inside of the clip.

6. Device according to any one of the preceding claims, characterised in that the scanning sensor (22) in the area in which is it is tangential to the thread balloon (B) has a pointy curvature (31, 31B) extending toward a perimeter of the thread balloon (B).

7. Device according to claim 1, characterised in that the scanning sensor (22) is in a form of a spring-loaded scanning feeler (32, 32A) bearing on the thread balloon (B) from outside of the spring-loaded scanning feeler (32, 32A).

8. Device according to claim 7, characterised in that the scanning feeler (32A) has a concave curvature (33) in relation to the thread balloon (B).

9. Device according to claim 1, characterised in that the device (6) is provided by means of which depending on the diameter of the thread balloon (B) the thread tension of an outer thread (5) can be adjusted.

10. Device according to claim 9, characterised in that the device (6) is connected to a control circuit (18) which processes the signals i of the sensor device (24).

11. Device according to claim 1, characterised in that the scanning sensor (22) can be positioned optionally in a position of rest (RS), in which there is no contact with the thread balloon (B).

12. Method for determining the diameter of a thread balloon (B) formed by a running outer thread (5) on a workstation (1) of a textile machine, wherein the textile machine having a plurality of workstations (1), each of which having a device (6) for influencing a yarn tension of the outer thread (5), which device (6) is connected to a control circuit (18), a spindle (2), a spindle pot (19) for receiving a second feed bobbin (15), a rotatable thread guiding device (20), a balancing system (9) for forming a cabling or cording point and a spooling and winding device (12), characterised in that the workstation (1) has a mechanical, contact scanning sensor (22) which is designed and arranged so that during the operation of the workstation (1) it is positioned by a yarn forming the thread balloon (B) in an operating position (BS) dependent on the diameter of the thread balloon (B), and the operating position (BS) of the scanning sensor (22), which is predefined by the diameter of the thread balloon (B), is sensed by a sensor device (24) provided with the workstation (1).

13. Method according to claim 12, characterised in that the scanning sensor (22) functions immediately on starting the workstation (1).

14. Method according to claim 12, characterised in that the operating position (BS) of the scanning sensor (22) sensed by the sensor device (24) is processed in the control circuit (18) and is used in the device (6) for influencing the thread tension of the outer thread (5) and/or an inner thread (16) on a cabling machine.

15. Method according to either claim 12 or claim 14, characterised in that the control circuit (18) controls the device (6) such that the thread balloon (B) always has an optimal diameter.

16. Method according to claim 12, characterised in that the scanning sensor (22) is used in the start/stop phase of a workstation (1) of the textile machine.

17. Method according to claim 12, characterised in that the scanning sensor (22) monitors thread breaks.

* * * * *